United States Patent [19]

Washino et al.

[11] Patent Number: 4,971,009

[45] Date of Patent: Nov. 20, 1990

[54] FUEL CONTROL APPARATUS FOR INTERNAL COMBUSTION ENGINE

[75] Inventors: Shoichi Washino; Satoru Ohkubo, both of Hyogo, Japan

[73] Assignee: Mitsubishi Denki Kabushiki Kaisha, Tokyo, Japan

[21] Appl. No.: 491,017

[22] Filed: Mar. 9, 1990

[30] Foreign Application Priority Data

Mar. 10, 1989 [JP] Japan ..... 1-58528
Mar. 28, 1989 [JP] Japan ..... 1-77664

[51] Int. Cl.[5] ..... F02D 41/18
[52] U.S. Cl. ..... 123/435; 123/494
[58] Field of Search ..... 123/435, 478, 494; 73/117.3, 118.2

[56] References Cited

U.S. PATENT DOCUMENTS 4,913,118 4/1990 Watanabe ..... 123/435

FOREIGN PATENT DOCUMENTS 103965 6/1984 Japan ..... 123/435
221433 12/1984 Japan .
212643 10/1985 Japan .
75325 4/1988 Japan ..... 123/435
75326 4/1988 Japan ..... 123/435

*Primary Examiner*—Tony M. Argenbright
*Attorney, Agent, or Firm*—Sughrue, Mion, Zinn, Macpeak & Seas

[57] ABSTRACT

A fuel control apparatus for an internal combustion engine comprises a pressure sensor for detecting the pressure in a combination chamber and a crank angle sensor for detecting a crank angle. During compression stroke, a microcomputer calculates the difference in pressure in the combustion chamber between two crank angles, or differentiates the pressure in the combustion chamber with respect to the crank angle at an arbitrary crank angle. Then, the microcomputer normalizes the pressure difference between the two crank angles by the pressure difference between the two crank angles when the engine is in an arbitrary reference condition, for example, its start condition, or normalizes the differentiated pressure at the arbitrary crank angle by the differentiated pressure at the arbitrary crank angle when the engine is in the arbitrary reference condition, for example, its start condition. The microcomputer then calculates the product of an amount of charged air and the pressure difference or the pressure differentiated which has been normalized, thereby producing a basic fuel injection.

4 Claims, 17 Drawing Sheets

FIG. 8

PRIOR ART

| BASIC INJECTION Tp(ms) | 800 | 2000 | 3200 | 4000 | 4800 | 5600 | 6400 |
|---|---|---|---|---|---|---|---|
| | 20 | 30 | 30 | 40 | 40 | 40 | 40 |
| 5 | 15 | 20 | 20 | 20 | 30 | 30 | 40 |
| 4 | 10 | 10 | 10 | 15 | 20 | 25 | 35 |
| 3 | 10 | 0 | 0 | 10 | 15 | 20 | 30 |
| 2 | 10 | 0 | 0 | 10 | 15 | 20 | 25 |
| 1 | 10 | 0 | 0 | 10 | 15 | 20 | 20 |
| 0 | | | | | | | |

ROTATIONAL SPEED N(rpm)

FUEL CONTROL APPARATUS FOR INTERNAL COMBUSTION ENGINE

BACKGROUND OF THE INVENTION

1. Field of the Invention

This invention relates to a fuel control apparatus for an internal combustion engine.

2. Prior Art

A wide variety of fuel control apparatuses have been used for providing optimum air-fuel ratioes. FIG. 7 shows one such prior art fuel control apparatus described in Japanese Patent Preliminary Publication No. 60-212643. A crank angle sensor 7 outputs a reference position pulse for each reference position of crank angle (every 180 deg. for four-cylinder engine and every 120 deg. for six-cylinder engine) and a unit angle pulse for each unit angle (eg. one degree). Thus, the crank angle can be determined by counting the unit angle pulses after the reference position pulse is inputted into a control apparatus 12. Further, the rotational speed of the engine can be determined by measuring the frequency or period of the train of unit pulses.

In FIG. 7, the crank angle sensor 7 is provided in the distributor.

The control apparatus 12 is formed of, for example, CPU, RAM, ROM, and I/O interface. The control apparatus 12 receives an intake-air flow rate signal S1 from an air flow meter 2, a water temperature signal S2 from a water temperature sensor 6, a crank angle signal S3 from the crank angle sensor 7, an exhaust signal S4 from an exhaust sensor 9, and a battery voltage signal and a fully-closed throttle signal (not shown), and calculates a fuel amount to be injected on the basis of these signals to provide an fuel injection signal S5. A fuel injection valve 10 is actuated by the fuel injection signal S5 to supply the engine with a required amount of fuel.

The fuel injection Ti to be injected is calculated by the control apparatus 12 using the following equation.

$$Ti = Tp\,(1 + Ft + KMR/100)\,\beta + Ts \qquad (001)$$

$$Tp = KQ/N$$

where Tp is a basic injection amount, Q is an intake air flow rate, N is a rotational speed of the engine, and K is a constant.

Ft is a correction factor dependent on the temperture of cooling-water of the engine, which is increasingly large with decreasing temperature. KMR is a correction factor when the engine is heavily loaded, and is read through table-look-up from a data table in which sets of data dependent on the basic injection amount Tp (ms) and the rotational speed N (rpm) are stored in advance as shown in FIG. 8. Ts is a correction factor for correcting fluctuation of the voltage which drives the fuel injection valve 10. $\beta$ is a correction factor dependent on the exhaust signal S4 from the exhaust sensor 9. Through the use of 62, the air-fuel ratio of the mixture can be feedback-controlled to a predetermined value, for example, a value close to the theoretical air-fuel ratio of 14.6. Where feedback control based on the exhaust siganl S4 is underway, the air-fuel ratio of the mixture is controlled to a constant value, in which case the corrections for the cooling-water and heavy load are meaningless. Thus, the feedback control using the exhaust signal S4 is carried out only when the correction factors Ft and KMR are zero. FIG. 9 illustrates the relation between the various sensors and the respective corrections calculated on the outputs of these sensors. For example, the signal from the air flow meter 2 is used to calculate the basic injection amount, the heavy load correction, and an injection amount when the engine is just started.

In the prior art fuel control apparatus described above, the intake air flow rate Q is measured by the air flow meter 2, and is then divided by the rotational speed N to obtain the basic injection Q. Thus the air flow meter 2 plays a fundamental role in the fuel control apparatus. The prior art apparatus suffers from the following drawbacks.

(1) An air flow meter is normally installed upstream of a surge tank. Therefore, during transient period in which the throttle opening changes abruptly, it measures not only the intake-air flow rate of the air flowing into the engine but also variations of the amount of air trapped in the inlet pipe (i.e., amount of air flowing into the inlet pipe), causing a difficulty in measuring an actual amount of air flowing into the engine and therefore disturbing the control of the air-fuel ratio.

(2) A large air flow meter is required, which is not preferable from a point of view of space factor.

(3) The output of the air flow meter is directly used to determine the fuel injection. This requires an accurate air flow meter.

Japanese Patent Preliminary Publication No. 59-221433 discloses a procedure for measuring the pressure in a combustion chamber to calculate an amount of air charged into the combustion chamber. As is apparent from FIG. 11, the air charge amount Ga is in a linear relation with the pressure difference $\Delta P$ within the cylinder, where $\Delta P$ is the pressure difference within the cylinder between the bottom dead center (BDC) and 40 deg. before the top dead center (BTDC 40 deg.) as shown in FIG. 10. The air charge amount is calculated on the basis of $\Delta P$ by using this relation. However, this procedure suffers from a drawback that the measurement accuracy is directly dependent on the gain of the sensor since a change in gain causes a change in the pressure difference $\Delta P$ for the same air charge amount.

SUMMARY OF THE INVENTION

An object of the present invention is to provide a fuel control apparatus capable of measuring the actual air charge amount flowing into the respective cylinders during transient period to thereby control the air-fuel ratio of the engine to a required value. Another object of the invention is to provide a fuel control apparatus capable of determining the fuel injection independent of fluctuation of gain, drift of output, and variation of the pressure sensor that detects the pressure in the combustion chamber.

A fuel control apparatus for an internal combustion engine comprises a pressure sensor for detecting the pressure in a combustion chamber and a crank angle sensor for detecting a crank angle. During compression stroke, a microcomputer calculates the difference in pressure in the combustion chamber between two crank angles, or differentiates the pressure in the combustion chamber with respect to the crank angle at an arbitrary crank angle. Then, the microcomputer normalizes the pressure difference between the two crank angles by the pressure difference between the two crank angles when the engine is in an arbitrary reference condition, for example, its start condition, or normalizes the differentiated pressure at the arbitrary crank angle by the differentiated pressure at the arbitrary crank angle when the engine is in the arbitrary reference condition, for example, its start condition. The microcomputer then calculates the product of an amount of charge air and the pressure difference or the pressure differenentiated which has been normalized, thereby producing a basic fuel injection.

BRIEF DESCRIPTION OF THE DRAWINGS

Features and other objects of the invention will be apparent from the detailed description of the preferred embodiments with reference to the accompanying drawings in which:

FIG. 8 shows a characteristic of the apparatus of FIG. 7, which shows the correction factor KMR while the engine is heavily loaded;

DESCRIPTION OF THE PREFERRED EMBODIMENTS

Operation

Figure 15:
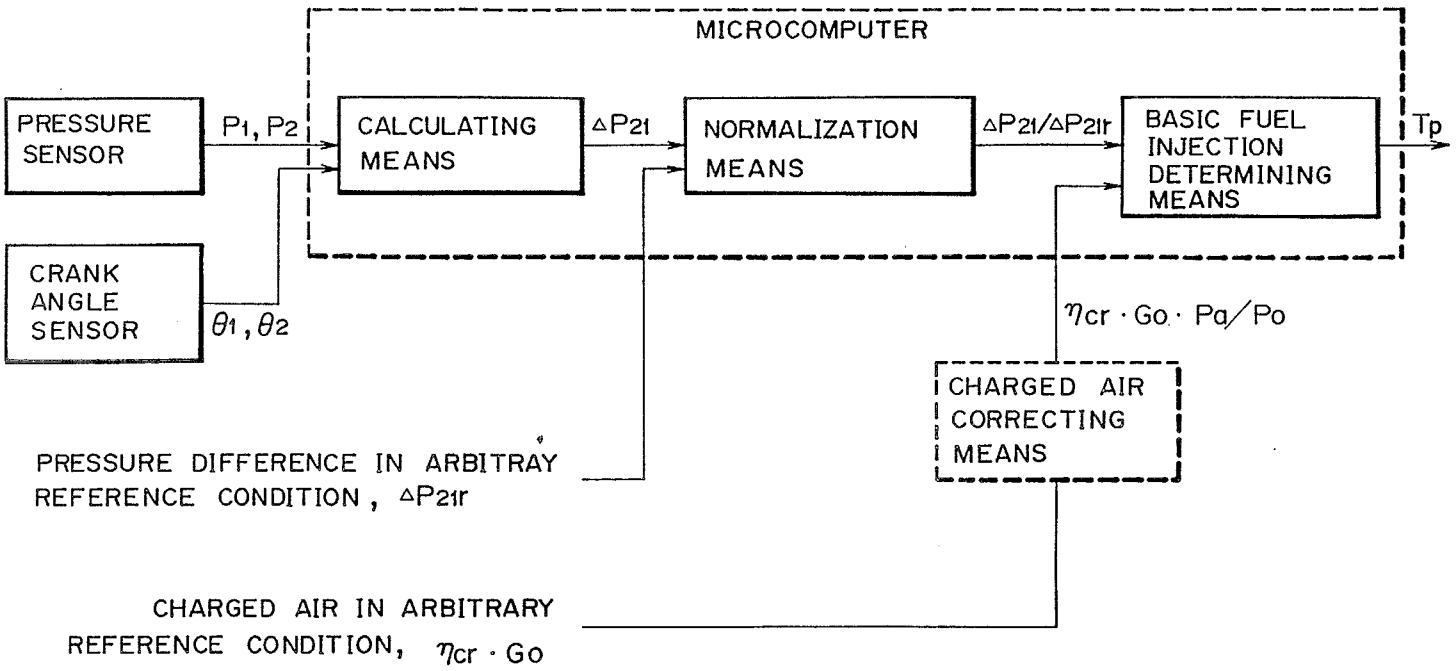
FIG. 15 shows the signal flow in the first embodiment of the invention.

FIG. 15 shows the operation of a first embodiment. The cylinder pressure sensor 13 detects the pressures in combustion chamber for two arbitrary crank angles $\theta 1$ and $\theta 2$ in a crank angle range where polytropic change is valid. Calculating means calculates the difference between the pressures during compression stroke (for example, crank angles 90 deg. after bottom dead center and 40 deg. before top dead center) to output a signal indicative of the pressure difference ΔP21. This signal is normalized by normalization means with respect to a pressure difference ΔP21r when the engine is in a reference condition (for example, when the throttle valve is fully opened or the engine is idle). Then, the product of the normalized signal and the air charge amount when the engine is in the arbitrary reference condition (e.g. the product of the charging efficiency eta c and the amount of air charged into the cylinder), is taken. On the basis of this product, the basic fuel injection Tp of the engine is determined by basic injection determining means.

Figure 16:
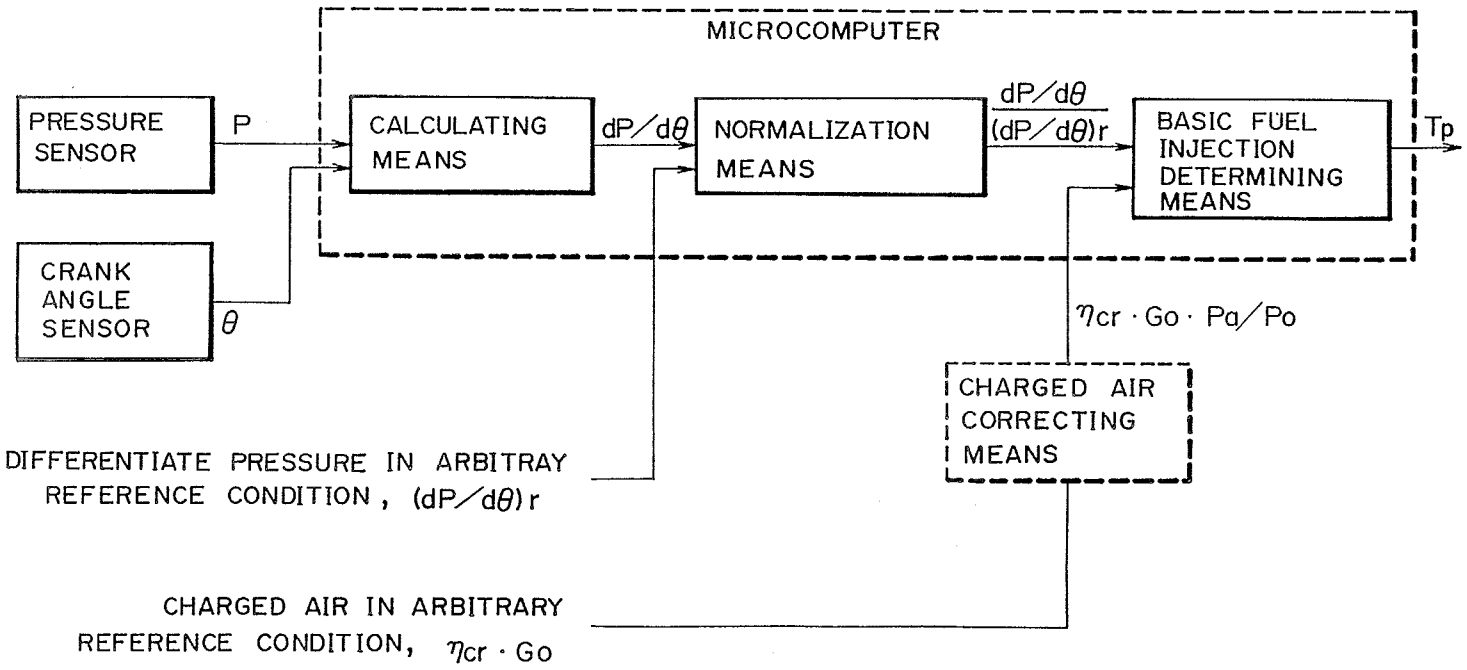
FIG. 16 shows the signal flow in the second embodiment of the invention.

FIG. 16 shows the operation of a second embodiment. The cylinder pressure sensor 13 detects the pressure in combustion chamber for an arbitrary crank angle $\theta$ in a crank angle range where polytropic change is valid. Calculating means calculates the derivative $dP/d\theta$ of the pressure with respect to the crank angle during compression stroke (for example, crank angles 90 deg. after bottom dead center and 40 deg. before top dead center) to output a signal indicative of the derivative. This signal is normalized by normalization means with respect to a $(dP/d\theta)r$ when the engine is in a reference condition (for example, when the throttle valve is fully opened or the engine is idle). Then, the product of the normalized signal is multiplied by the air charge amount when the engine is in the arbitrary reference condition (e.g. the product of the charging efficiency eta c and the amount of air charge into the cylinder). On the basis of this product, the basic fuel injection Tp of the engine is determined by basic injection determining means.

First Embodiment

Figure 1:
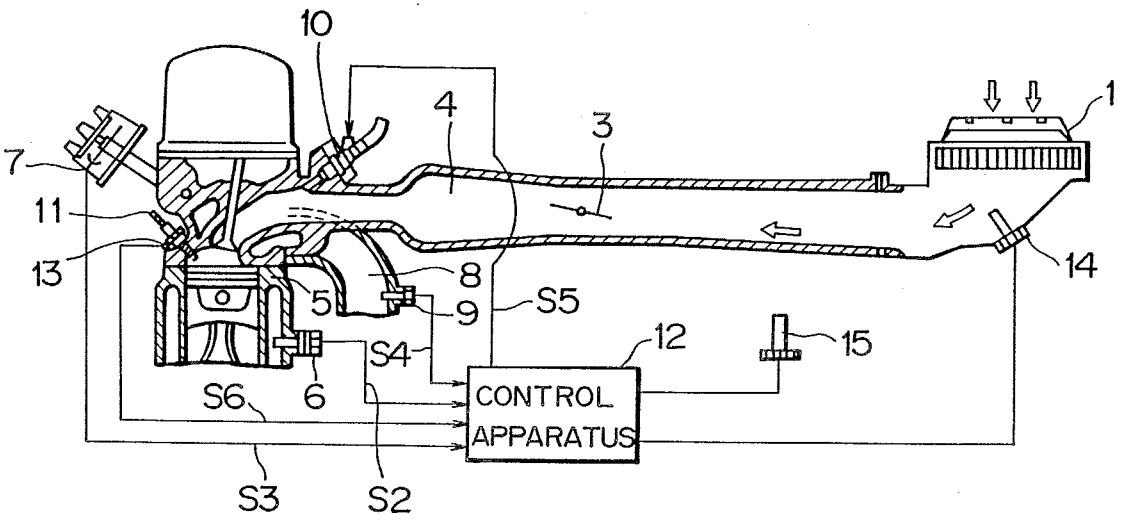
FIG. 1 show a first and a second embodiment of a fuel control apparatus according to the present invention.
Figure 2A:
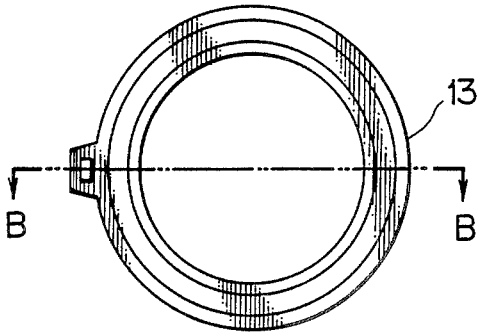
FIGS. 2A–2C are diagrams for showing an example of a pressure sensor used to detect the pressure in the combustion chamber.
Figure 2B:
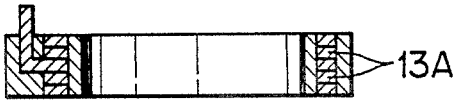
Figure 2C:
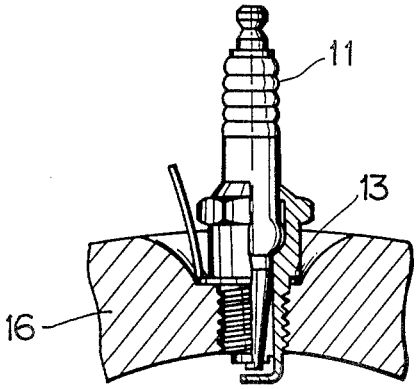

A first embodiment of the invention will now be described with reference to the drawings. Referring to FIG. 1, a cylinder pressure sensor 13 detects the pressure in the combustion chamber, an intake air temperature sensor 14 detects the temperature of the intake air, and an atmospheric pressure sensor 15 detects an atmospheric pressure. FIG. 2A shows a top view of the cylinder pressure sensor 13 and FIG. 2B shows a cross-sectional view taken along the line 2B—2B. FIG. 2C is a cross-sectional view, in part, for showing the cylinder pressure sensor 13 when mounted to the engine. A piezoelectric element 13A is of a gasket type which is securely sandwiched between an ignition plug 11 and a cylinder head 16. The output of the sensor 13 is the derivative of the pressure with respect to time and is integrated by an integrator in the interface circuit. The procedure for determining the fuel injection amount will be described with reference to FIG. 3.

Figure 3:
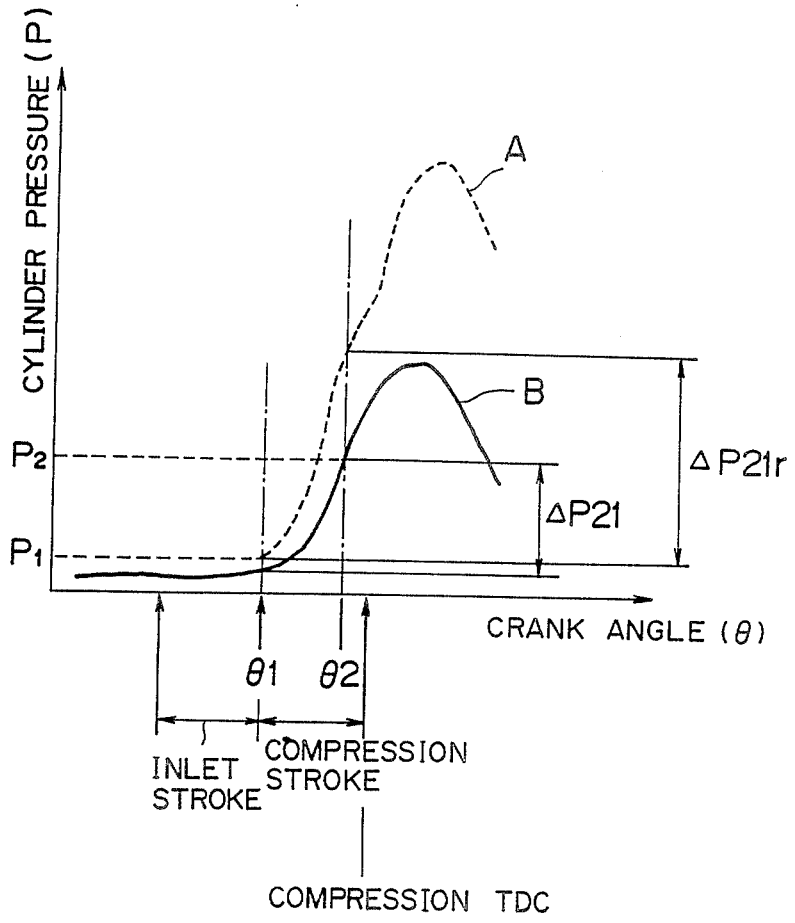
FIG. 3 is a graph for showing the relation between the crank angle $\theta$ and the pressure P in the cylinder, which is used in the first embodiment.

FIG. 3 is a diagram for showing cylinder pressure P vs crank angle $\theta$. The cylinder pressure during air intake and compression stroke is depicted in dotted line A when the engine is in the reference condition, for example, when the throttle valve is fully opened. The solid line B represents the cylinder pressure when the engine is in the arbitrary condition. $\theta 2$ denotes one of the arbitrary crank angles during compression stroke and $\theta 1$ the other angle.

For reasonable crank angles during the compression stroke, the polytropic change is generally valid between the cylinder pressure P and the volume V of the cylinder. Thus the following relation exists.

$$PV^n = \text{a constant} \quad (102)$$

Therefore, P2 and P1 are related as follows:

$$P2 = P1(V1/V2)^n \quad (103)$$

where P1 and V1 denote the cylinder pressure and the volume of the cylinder, respectively, for the crank angle θ1. P2 and V2 denote the cylinder pressure and the volume of the cylinder, respectively, for the crank angle θ2.

The pressure difference ΔP21 and between P2 and P1 is given by $$\Delta P21 = P1\{(V1/V2^n - 1)\} \quad (104)$$

where n is a polytropic index and is usually smaller than the ratio k of specific heats of air, V1 and V2 are known, and n can be determined in advance. Thus, Eq(104) indicates that the pressure P1 can be determined by measuring the pressure difference ΔP21.

Eq. (105) can be obtained by normalizing ΔP21 with respect to ΔP21r, where ΔP21r for the dotted line A corresponds to ΔP21 for the solid line B.

$$\frac{\Delta P21}{\Delta P21r} \quad \frac{P1}{P1r} \quad (105)$$

Here, the polytropic index remains the same regardless of the operating state of the engine.

We also have the following relation from equation of state.

$$P1V1 = GzRT1$$

$$Gz = Ga + Ge$$

where R is the gas constant, T1 is the temperature at the crank angle θ1, Ga is the charged air amount, and Ge is the residual exhaust gas contained in the cylinder gas Gz.

Defining the residual exhaust gas rate ηe by $$\eta = Ge/Gz$$

thus $$P1 = Ga(1 + Ge/Ga)RT1/V1 = GaRT1/\{V1(1-\eta e)\}$$

Furthermore, from the definition of charging efficiency, $$Ga = \eta c\ Go$$

where Go is an amount of air suctioned into the cylcinder under the standard atmosphere (Po, To, one atmosphere and 0 degree Celcius and ηc is a charging efficiency. Thus, P1 is ultimately given as follows:

$$P1 = \eta c\ GoRT1/\{V1(-\eta e)\}$$

Expressing the cylinder pressure at the angle θ, in the reference condition of the engine by P1r, Eq(105) is rewritten as follows:

$$\frac{\Delta P21}{\Delta P21r} \quad \frac{\eta\ c\ T1}{\eta\ cr\ T1r} \quad \frac{(1 - \eta\ er)}{(1 - \eta\ e)} \quad (106)$$

where the quantities with a suffix r are those in the reference condition.

Figure 4:
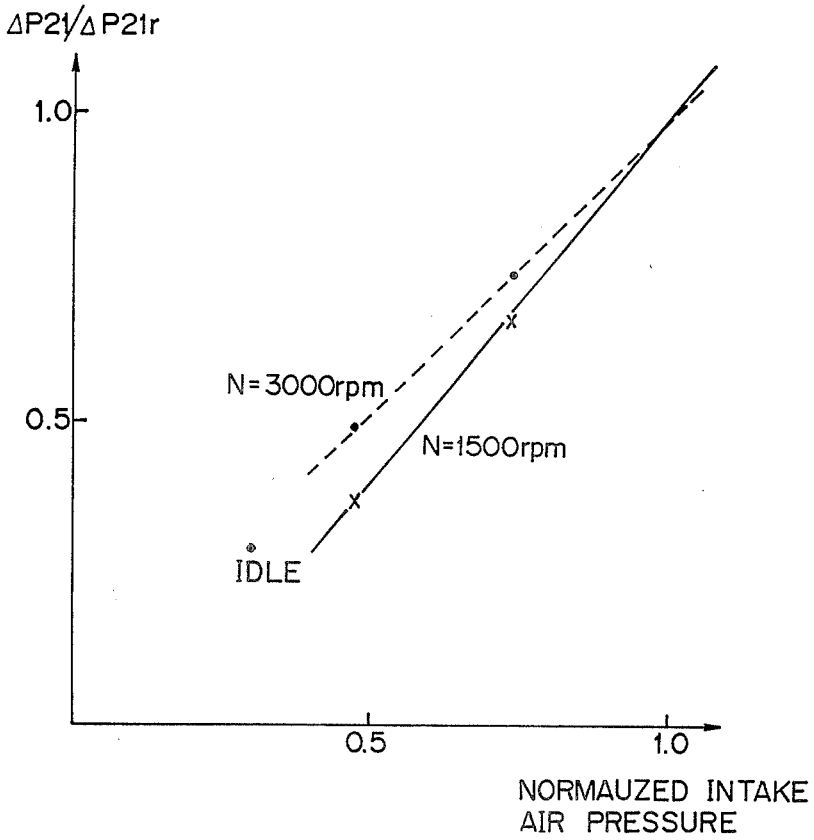
FIG. 4 is a graph for showing the relation between the normalized intake-air pressure and Δ21/ΔP21r according to the first embodiment.

FIG. 4 illustrates the relation between ΔP21/ΔP21r on the left hand of Eq(106) and the normalized air intake which is obtained by normalizing the air intake in the manifold with respect to the atmospheric pressure. The abscissa indicates the normalized intake air pressure and the ordinate represents ΔP21/ΔP21r. The solid line indicates the characteristic for N=1500 rpm, and the dotted line for N=3000 rpm. FIG. 4 shows a case where the fully opened throttle valve is considered to be the reference condition. It should be noted that since the intake air pressure is proportional to the charged air amount, the left hand of Eq(106) well represents the charged air amount. As will be described later, it should be noted that FIG. 4 shows the characteristics specific only to the engine involved.

Eq(106) can be rewritten as follows:

$$\eta\ cGo = \frac{\Delta P21}{\Delta P21r} \quad \frac{T1r}{T1} \quad \frac{(1 - \eta\ e)}{(1 - \eta\ cr)}\ \eta\ cr\ Go \quad (107)$$

For ηc Go, the fuel supply Gf for the required air-fuel ratio F/A is derived from Eq(107) as follows:

$$Gf = F/A\ \eta\ cGo = \frac{\Delta P21}{\Delta P21r} \quad \frac{T1r}{T1} \quad \frac{(1 - \eta\ e)}{(1 - \eta\ cr)}\ \eta\ cr\ Go$$

Therefore, the fuel injection Ti for the air-fuel ratio F/A is given by $$Ti = Tp = \frac{T1r}{T1} \quad \frac{(1 - \eta\ e)}{(1 - \eta\ er)} \quad (108)$$

where the basic fuel injection Tp is given by $$Tp = \frac{\Delta P21}{\Delta P21r}\ \eta\ cr\ Go \quad (109)$$

In other words, correcting the basic fuel injection Tp in Eq(109) with respect to the temperature T and the residual exhaust gas rate Ge/Gz will give the fuel injection Ti. That is, it is only necessary to research the value of ηcr for the engine and to store the value thus obtained into a ROM in the microcomputer so that ΔP21 and ΔP21r are measured with cylinder pressure sensor being mounted to the vehicle, then ΔP21/ΔP21r is calculated, and then the basic fuel injection Tp can be calculated by multiplying the value of ΔP21/ΔP21r by the eta cr which is read from the ROM.

Further, the basic coefficient (Tr/T)(1−ηe)/(1−ηer) for the temperature and residual exhaust gas rate can be determined in advance, and the basic coefficient is then multiplied by Tp read from the ROM, thereby determining the fuel injection Ti.

For an actual vehicle, when the procedure described above is to be carried out, the initial start of the engine should be selected as the reference condition because the initial start is a state that the engine first undergoes whenever the engine is to be operated. The idle condition of the engine may alternatively be selected, after the engine has been warmed up, as the reference.

As will be described later, the basic coefficient of the engine will be given by (Tr/T)(1−ηe)/(1−ηer), which is specific to the engine involved once the cooling-water temperature, intake air temperature, atmospheric pressure, rotational speed, and valve timing are determined. Thus, the basic coefficient may be calculated in advance and stored in the ROM. The variations of the basic coefficient due to the intake air temperature, atmospheric pressure, rotational speed, and cooling-water temperature can also be determined and are stored in the ROm in advance. In this manner, the fuel injection Ti can be obtained.

The properties of ΔP21/ΔP21r will now be discussed below.

Since the ΔP21/ΔP21r is based on the pressure difference in the cylinder, it is immune to the drift in output of the cylinder pressure sensor. The effect of the variations in gain of the sensor on the sensor output is also eliminated since division is involved. Therefore, it can be said that the characteristics in FIG. 4 are specific to the engine and are affected only by the load (given by ΔP21/ΔP21r), cooling-water temperature, intake air temperature, atmospheric pressure, rotational speed, and valve timing. For example, a change in cooling-water temperature causes a change in heat loss as well as a change in polytropic index n. A change in intake air temperature causes a change in T/Tr. Also, the value of $(1-\eta er)/(1-\eta e)$ changes with the valve timing. Further, a change in atmospheric pressure also causes a change in charging efficiency ηcr when the engine is in the reference condition. However, the change in the charging efficiency ηcr may be easily corrected by providing a charging efficiency correcting means as shown in FIG. 15, which detects the atmospheric pressure Pa and then calculates Pa/Po with the engine being mounted to the vehicle.

The characteristics in FIG. 4 should be of a straight line passing through the origin if the basic coefficient $$\frac{Tr}{T}\ \frac{(1-\eta\, e)}{(1-\eta\, er)}$$

in Eq(106) is constant. The lines in FIG. 4 are straight lines generally passing through the orgin though they deviate somewhat from the origin depending on the rotational speed. The "idle" point is also nearly on the straight line.

Thus, the fuel injection Ti and the basic fuel injection Tp are given as follows:

$$Ti = Tp\frac{T}{Tr}\ \frac{(1-\eta\, er)}{(1-\eta\, e)}\, f1\, f2\, f3\, f4 \tag{110}$$

$$Tp = \frac{\Delta P21}{\Delta P21r}\ \eta\, cr\, Go\, \frac{Pa}{Po} \tag{111}$$

where f1 is a correction coefficient for the intake air temperature Ta and the load, f2 is for cooling-water temperature Tw, f3 is for the atmospheric pressure Pa, and f4 is for the rotational speed N and the load. It should be noted that in addition to Eq(111) the actual fuel injection also requires corrections for Ft, KMR, and β because the corrections for Ft, KMR, and β are necessary regardless of how the basic injection is determined.

Figure 5A:
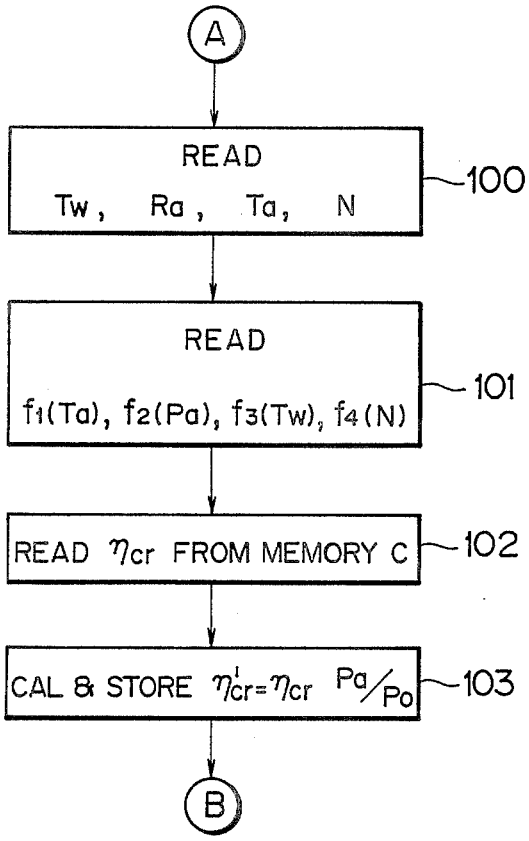
FIGS. 5A–5B are flowcharts for showing the signal processing in the first embodiment.

FIG. 5 shows a program for implementing the first embodiment of the present invention. The program serves as calculating means, normalization means, and basic injection determining means. FIG. 5A shows only relevant part of the main routine involved in the first embodiment.

The cooling-water temperature Tw, atmospheric pressure Pa, intake air temperature Ta, and rotational speed N are read in from the sensors at step 100. The values stored in the memory are referred to determine the correction coefficients f1(Ta), f2(load, Tw) for the cooling-water temperature, f3(Pa) for the atmospheric pressure Pa, and f4(load, N) for the rotational speed.

Figure 5B:
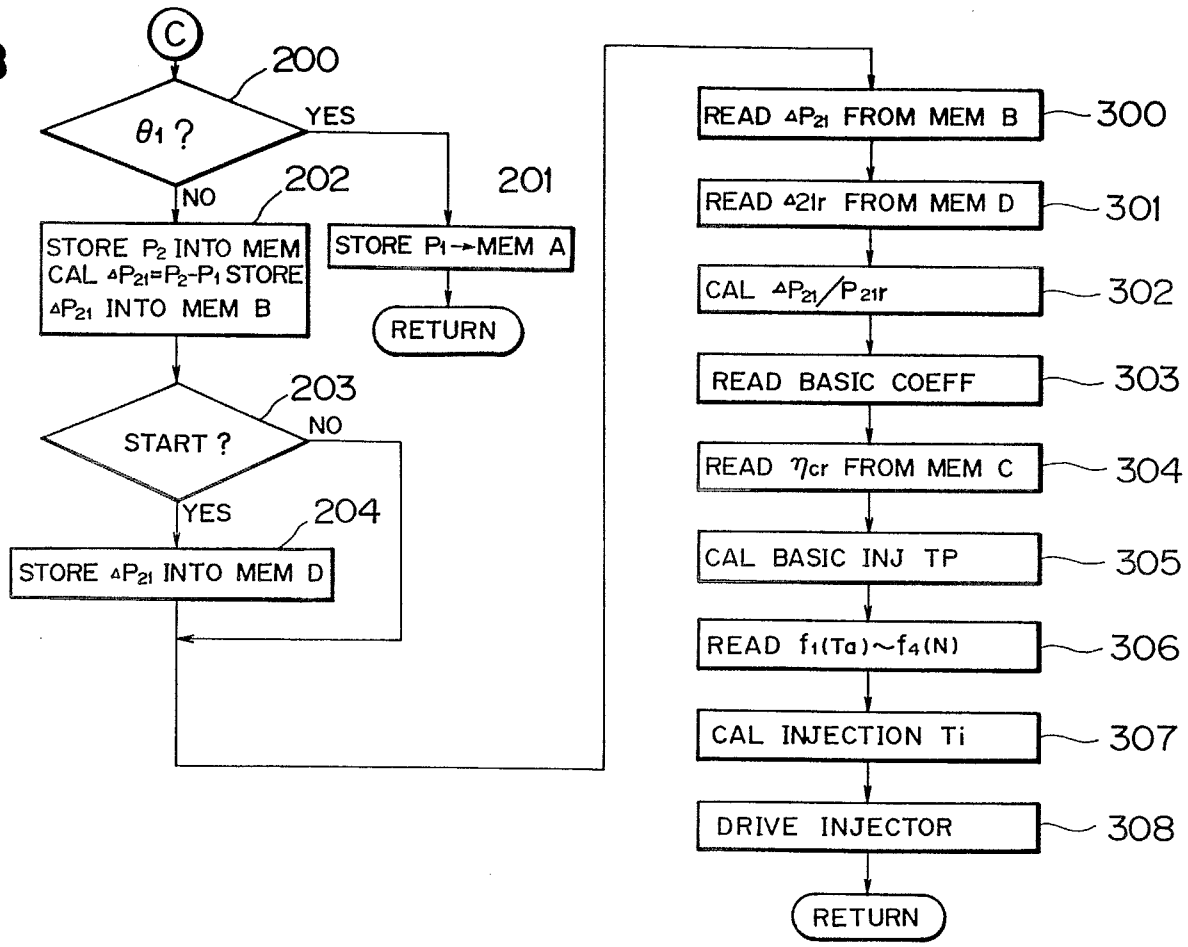

Then, ηcr is read from the memory C at step 102 and at step 103 ηcr Pa/Po is calculated and stored again into the memory C. Then the program jumps to the fuel injection calculation interrupt routine (steps 300–308) which is called upon a crank angle interrupt generated for each of the crank angles θ1 and θ2. The ηcr Pa/Po is used to calculate Tp when the fuel injection calculation interrupt routine in FIG. 5B is executed. At step 200 in FIG. 5B, a decision is made based on whether or not the crank angle signal S3 indicates θ1. If the crank angle is θ1, then the program proceeds to step 201 to store the value P1 of the pressure signal S6 at that time into the memory A and returns to the main routine; if not θ1, the crank angle is recognized as being θ2 and therefore the difference ΔP21 between P1 and P2 at that time is calculated and stored into the memory B. At step 203, a decision is made based on whether or not the condition of engine is "start", and if "start", then the value of the difference ΔP21 in the memory B is stored into the memory D, and thereafter steps 300–308 are executed to perform the fuel injection calculation interrupt. The value of ΔP21 is used as the pressure difference ΔP21r in the reference condition when calculating the fuel injection.

In the interruption for the fuel injection calculation in FIG. 5B, ΔP21 is first read out from the memory B at step 300, then ΔP21r is read out from the memory D, and then the ratio ΔP21/P21r is calculated at step 302. The basic coefficients for ΔP21/P21r are read from the memory at step 303, then ηcr Pa/Po is read as η'cr from the memory C at step 304, and the product of the values obtained in steps 302–304 is obtained to calculate the basic injection Tp at step 305. Then the values of the corrections f1, f2, f3, 3, and f4 are read out at step 306, the fuel injection Ti is calculated at step 307, and then returns to the main routine after the injector is driven at step 308. The steps 200–308 described above are repeated whenever the crank angle interrupt for each of the crank angles θ1 and θ2 is activated.

The first embodiment has been described assuming that the polytropic index n is the same for both the arbitrary and reference conditions of the engine. If the two conditions differ in the index n, the following relation is obtained.

$$\frac{\Delta P21}{\Delta P21r}\ \frac{P1}{P1r}\ \frac{\{(V1/V2)^{n}-1\}}{\{(V1/V2)^{nr}-1\}}$$

thus Eq(108) representing Ti is simply modified by introducing a correction factor for the polytropic index n. The value of this correction factor depends on the load and the rotational speed of the engine. This value may be included in the correction f4(load, N) as well as f4(ΔP21/ΔP21r, N).

The operation in FIG. 5B is carried out when the crank interrupt is activated but the operation may be carried out by monitoring the crank angles at all times to detect a predetermined crank angle. Although ΔP21r is directly stored into the memory D after it is detected, the value of ΔP21r before the engine is mounted to the vehicle may be measured as ΔP21ro, and the ratio Kg1 of P21ro to ΔP21r may be stored in the memory D, in which case ΔP21/ΔP21r can be obtained by $$\frac{\Delta P21}{\Delta P21r}\ \frac{\Delta P21}{\Delta P21ro}\ Kg1$$

Second Embodiment

Figure 12:
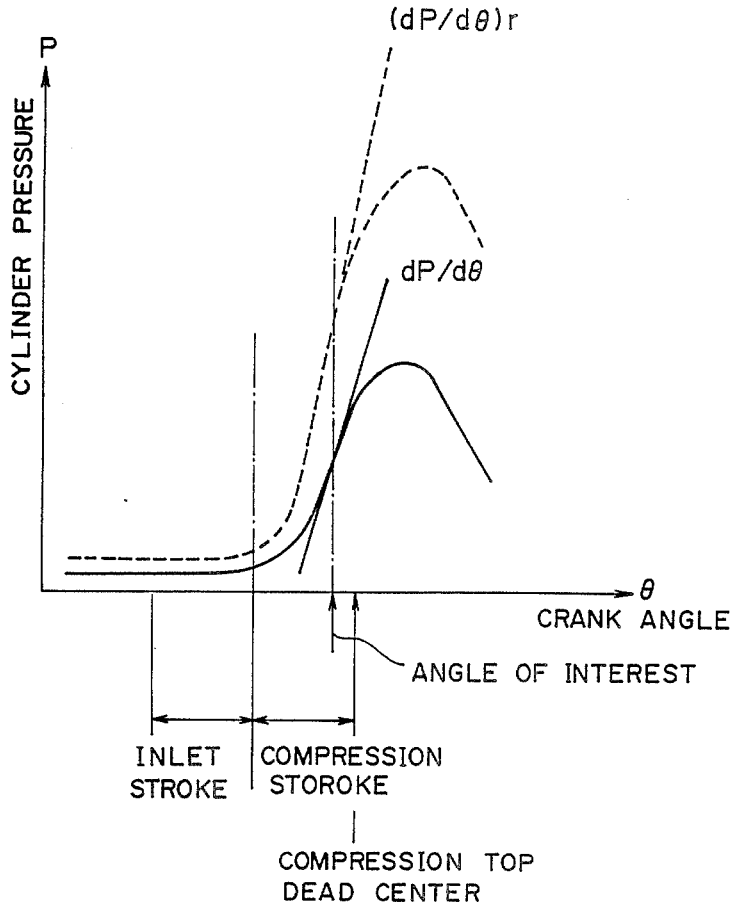
FIG. 12 is a graph for showing the relation between the crank angle $\theta$ and the pressure P in the cylinder, which is used in a second embodiment.

FIG. 12 is a graph for showing the relation between the crank angle $\theta$ and the pressure P in the cylinder, which relation is used in a second embodiment.

The dotted line indicates the pressure in the cylinder 5 when the engine is in the reference condition as in the first embodiment, such as suction stroke or compression stroke when the throttle valve 3 is fully opened, while the solid line represents the pressure when the engine is in the arbitrary condition. For reasonable crank angles during the compression stroke, the polytropic change is generally valid between the cylinder pressure P and the volume V of the cylinder. Thus the following relation exists.

$$PV^n = a \tag{202}$$

where a is a constant.

Differentiating Eq(202) with respect to the crank angle $\theta$, we obtain $$\frac{dP}{d\theta} V^{-n} = -naV^{-(n+1)} \frac{dV}{d\theta} \tag{203}$$

Putting Eq(202) into Eq(203), we obtain $$\frac{dP}{d\theta} = -nP \frac{dV/d\theta}{V} \tag{204}$$

or $$P = \frac{V}{n} \frac{dP/d\theta}{dV/d\theta}$$

where n is the polytropic index and is smaller than the ratio k of specific heats of air. V and $dV/d\theta$ are known and n can be determined by researching it in advance. Thus, the pressure P in the cylinder can be determined by measuring $dP/d\theta$. Assuming that the polytropic index n will not change, Eq(205) is obtained by normalizing $dP/d\theta$ with respect to $(dP/d\theta)r$ as follows:

$$\frac{(dP/d\theta)}{(dP/d\theta)r} = \frac{P}{Pr} \tag{205}$$

where $(dP/d\theta)r$ is a quantity corresponding to the dotted line in FIG. 12, and $(dP/d\theta)$ is a quantity corresponding to the solid line, and Pr is the cylinder pressure when the engine is in the reference condition.

We also have the following relation from equation of state.

$$PV = GzRT$$

$$Gz = Ga + Ge$$

where R is the gas constant, T is the temperature of a gas at the crank angle $\theta 1$, Ga is an amount of air charged, Ge is residual exhaust gas of the gas Gz contained in the cylinder.

Defining residual exhaust gas rate $\eta e$ by $$\eta e = Ge/Gz$$

we obtain $$P = Ga(1 + Ge/Ga)RT/V = GaRT/\{V(1-\eta e)\}$$

Furthermore, from the definition of charging efficiency, $$Ga = \eta c\ Go$$

where Go is an amount of air suctioned into the cylinder at the standard atmosphere (Po, To). Thus, P is ultimately given as follows:

$$P1 = \eta c\ GoRT1/\{V(1-\eta e)\}$$

Figure 13:
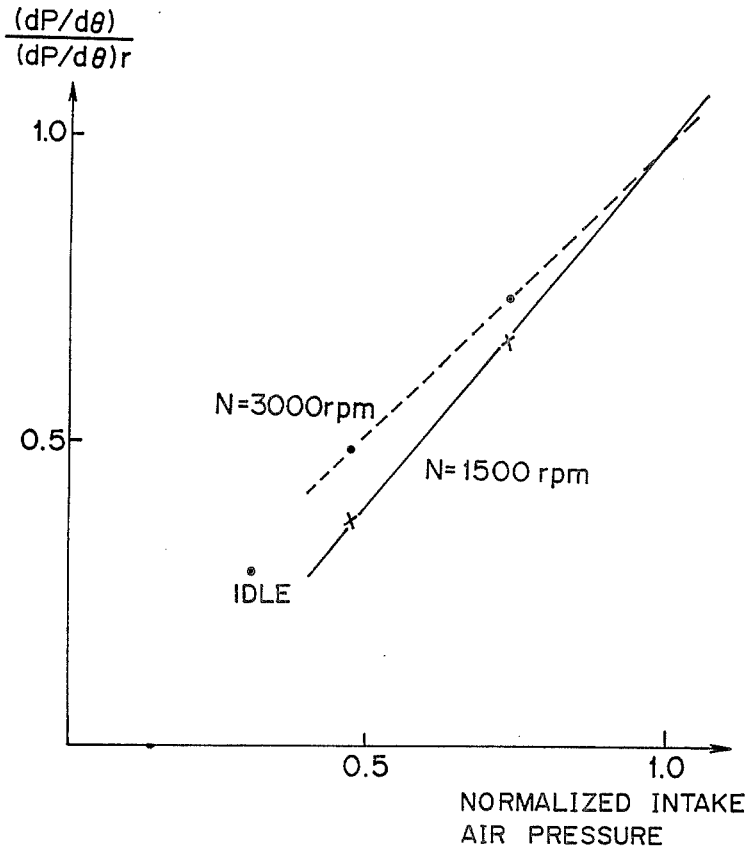
FIG. 13 is a graph for showing the relation between normalized intake-air pressure and $(dP/d\theta)/(dP/d\theta)r$ according to the second embodiment.

Thus, Eq(205) is rewritten as follows:

$$\frac{(dP/d\theta)}{(dP/d\theta)r} = \frac{(\eta\ c\ T}{\eta\ cr\ T1r} \frac{(1-\eta\ er)}{(1-\eta\ e)} \tag{206}$$

where the quantities with a suffix r are those in the reference condition. FIG. 13 illustrates $(dP/d\theta)/(dP/d\theta)r$ on the left hand of Eq(206) vs the normalized air intake which is obtained by normalizing with respect to the atmospheric pressure. The abscissa indicates the normalized intake air pressure and the ordinate represents $(dP/d\theta)/(dP/d\theta)r$. The solid line indicates the characteristic for N=1500 rpm, and the dotted line for N=3000 rpm. FIG. 13 shows a case where the throttle valve 3 is fully open when the engine is in the reference condition. Since the intake air pressure is proportional to the charged air amount, the left hand of Eq(206) well represents the charged air amount. Thus, as will be described later, it can be said that FIG. 13 shows the characteristics specific only to the engine involved.

Now, Eq(206) can be rewritten as follows:

$$\eta\ cGo = \frac{(dP/d\theta)}{(dP/d\theta)r} \frac{Tr}{T} \frac{(1-\eta\ e)}{(1-\eta\ er)} \eta\ cr\ Go \tag{207}$$

For $\eta c$ Go, the fuel supply Gf for the required air-fuel ratio is derived from Eq(107) as follows:

$$\begin{aligned} Gf &= F/A\ \eta\ cGo \\ &= F/A \frac{(dP/d\theta)}{(dP/d\theta)r} \frac{Tr}{T} \frac{(1-\eta\ e)}{(1-\eta\ cr)} cr\ Go \end{aligned}$$

where F/A is the air-fuel ratio.

Therefore, the fuel injection Ti for the air-fuel ratio F/A is given by $$Ti = Tp \frac{Tr}{T} \frac{(1-\eta-e)}{(1-\eta\ er)} \tag{208}$$

where the basic fuel injection Tp is given by $$Tp = \frac{(dP/d\theta)}{(dP/d\theta)r} \eta\ cr\ Go \tag{209}$$

Correcting the basic fuel injection Tp in Eq(209) with respect to the temperature T and the residual exhaust gas rate Ge/Gz will give the fuel injection Ti. Thus, it is only necessary to research the value of $\eta$cr for the engine and to store the value of $\eta$cr thus obtained into a ROM in the microcomputer so that $dP/d\theta$ and $(dP/d\theta)r$ are measured with cylinder pressure sensor being mounted to the vehicle, then $(dP/d\theta)/(dP/d\theta)r$ is calculated, and the basic fuel injection Tp can be calculated by multiplying the value of $(dP/d\theta)/(dP/d\theta)r$ by the $\eta$cr which is read from the ROM. Further, the basic coefficient $(Tr/T)(1-\eta er)$ for the temperature and residual exhaust gas rate can be determined in advance, and is then multiplied by Tp read from the ROM, thereby determining the fuel injection Ti.

For the actual vehicle, when the above-described procedure is to be carried out, the initial start of the engine should be selected as the reference condition because the start is a state that the engine first undergoes whenever the engine is to be operated. The idle condition of the engine may be selected as the reference once the engine has been warmed up.

As will be described later, the basic coefficient $(Tr/T)(1-\eta\%)/(1-\eta er)$ of the engine will become specific to the engine involved once the cooling-water, intake air temperature, atmospheric pressure, rotational speed, and valve timing are fixed, thus the basic coefficients may be calculated in advance and stored in the ROM. The variations of the basic coefficient can also be determined in advance with respect to the intake air temperature, atmospheric pressure, rotational speed, and cooling-water temperature and is stored in the ROM. In this manner, the fuel injection Ti can be obtained.

Since the $(dP/d\theta)/(dP/d\theta)r$ is based on the pressure difference in the cylinder 5, it is immune to the drift in the output of the cylinder pressure sensor 13. The effect of the variations in gain of the sensor 13 on the sensor output is also eliminated since division is involved. Therefore, it can be said that the characteristics in FIG. 13 are specific only to the engine and are affected only by the cooling-water temperature, intake air atomspheric pressure, rotational speed, and valve timing. For example, a change in cooling-water temperature causes a change in heat loss as well as a change in polytropic index n. A change in intake air temperature causes a change in T/Tr. Also, the value of $(1-\eta er)/(1-\eta e)$ changes with the valve timing. Further, a change in atmospheric pressure also causes a change in charging efficiency. $\eta cr$ when the engine is in the reference condition. However, the change in the charging efficiency $\eta cr$ may be easily corrected by providing a charging efficiency correcting means as shown in FIG. 16, which detects the atmospheric pressure Pa and then calculates Pa/Po.

The characteristics in FIG. 13 should be of a straight line passing through the origin if the basic coefficient $(T/Tr)(1-\eta er)/(1-\eta e)$ in Eq(206) is constant. In fact, the lines in FIG. 13 are straight lines substantially passing through the origin. The "idle" point is also nearly on the straight lines.

Thus, the fuel injection Ti and the basic fuel injection Tp are given as follows:

$$Ti = Tp\frac{T}{Tr}\ \frac{(1-\eta\, er)}{(1-\eta\, e)}\ f1\, f2\, f3\, f4 \tag{210}$$

$$Tp = \frac{dP/d\theta}{(dP/d\theta)r}\ \eta\, cr\ Go(Pa/Po) \tag{211}$$

It should be noted that in addition to Eq(208) the actual fuel injection also requires corrections for Ft, KMR, and $\beta$ because the corrections for Ft, KMR, and $\beta$ are necessary corrections regardless of how the basic injection Tp is determined.

Figure 14B:
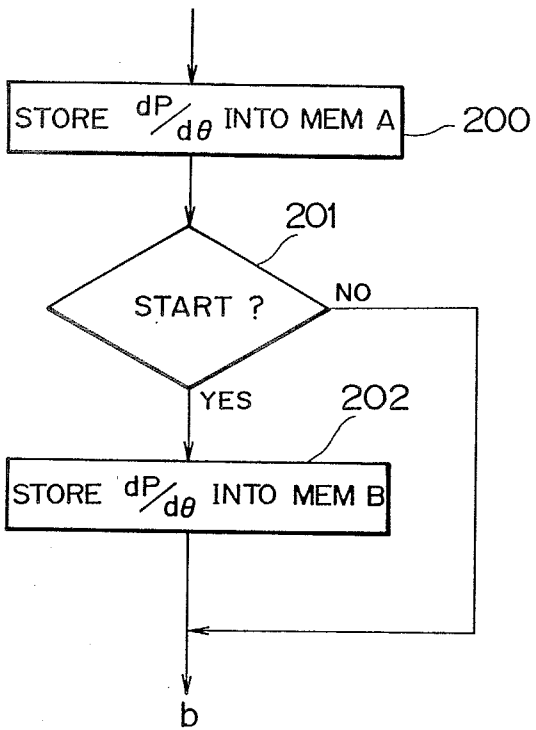
FIGS. 14A–14C are flowcharts for showing the signal processing in the second embodiment.
Figure 14A:
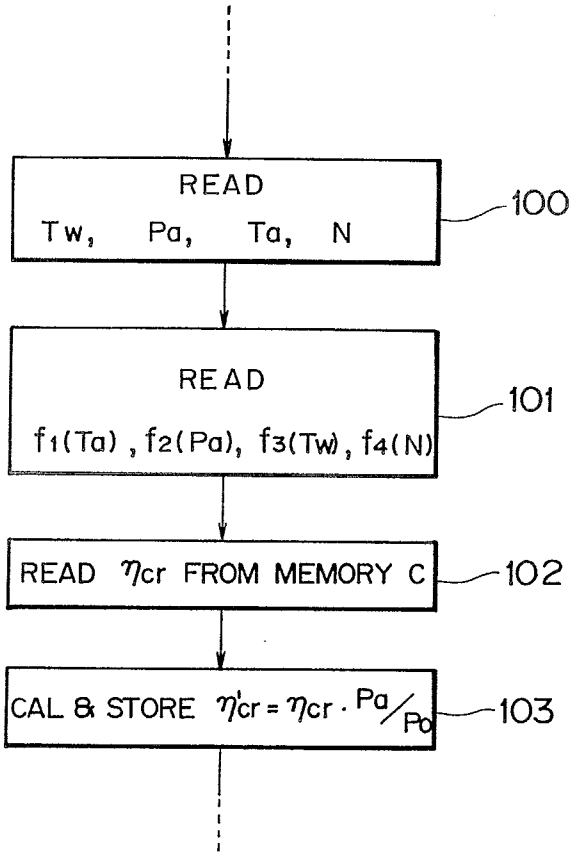
Figure 14C:
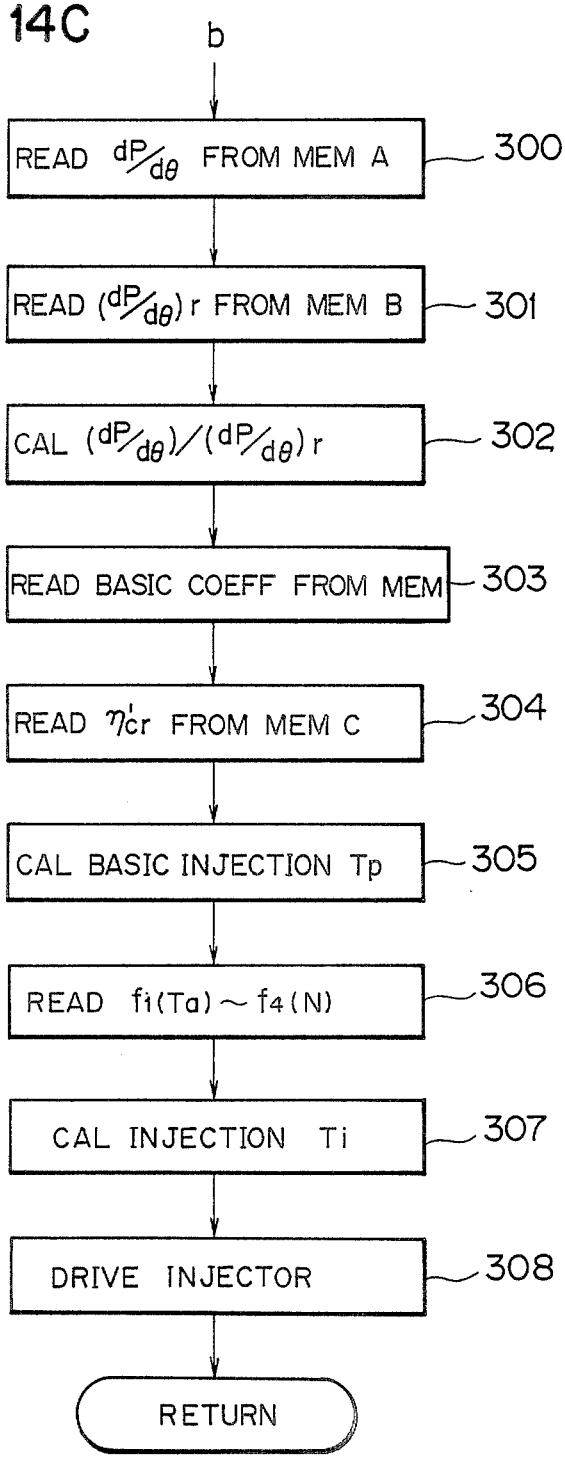

FIGS. 14A–14C are the flowcharts of a program for implementing the second embodiment of the invention. The program serves as calculating means, normalization means, and injection determining means. FIG. 14A shows only part of the main routine involved in the second embodiment.

At step 100, the cooling-water temperature Tw, atmospheric pressure Pa, intake air temperature Ta, and rotational speed N are read in from the sensors. The correction coefficients f1(Ta), f2(load, Tw) for the cooling-water temperature, f3(Pa) for the atmospheric pressure Pa, and f4(load, N) for the rotational speed are determined by reading values from the memory.

Then, $\eta cr$ is read from the memory C at step 102 and $\eta' cr = \eta cr\ Pa/Po$ is calculated and stored again into the memory C at step 103. Then the program jumps to the fuel injection calculation interrupt routine which is called upon a crank angle interrupt generated for each of the crank angles $\theta 1$ and $\theta 2$. The $\eta' cr$ is used to calculate Tp when executing a fuel injection calculation interrupt routine in FIG. 14B. At step 200 in FIG. 14B, the value of $dP/d\theta$ for the predetermined angle at which the interrupt occurs, is stored into the memory A. At step 201, a decision is made based on whether or not the engine condition is "start". If the engine condition is the "start," then the same value of $dP/d\theta$ as step 200 is stored into the memory B and is used as $(dP/d\theta)r$ to calculate the fuel injection Ti when the interrupt routine in FIG. 14C is called; if not the "start," then the program proceeds to step 300.

In FIG. 14C, the value of $dP/d\theta$ is read from the memory A at step 300, and the value of $(dP/d\theta)r$ is read from the memory B at step 301, and then the ratio $(dP/d\theta)/(dP/d\theta)r$ is calculated at step 302. The basic coefficient that corresponds to $(dP/d\theta)/(dP/d\theta)r$ is read out at step 303, $\eta' cr = \eta cr\ Pa/Po$ is read at step 304, and the basic fuel injection Tp is calculated by taking the product of the values obtained at steps 302, 303, and 304. Then, the correction coefficients f1–f4 are read at step 306, the fuel injection Ti is calculated at step 307, and the fuel injection valve 10 is driven at step 308. Thereafter the program returns to the main routine. The interrupt routine is resumed when the crank angle interrupt for each of the crank angles $\theta 1$ and $\theta 2$ is activated again.

The second embodiment has been described assuming that the polytropic index n is the same for both the arbitrary condition of the engine and the reference condition of the engine. If the two conditions differ in index n, the following relation is obtained.

$$\frac{(dP/d\theta)}{(dP/d\theta)r} = \frac{P}{Pr}\ \frac{n}{nr}$$

thus Eq(208) representing Ti is simply modified by introducing a correction factor related to polytropic index n. The value of this correction factor depends on the load and the rotational speed of the engine. This value may be included in the correction $f4\{(dP/d\theta)/(dP/d\theta)r, N\}$.

The piezoelectric type pressure sensor shown in FIG. 2 inherently detects the cylinder pressure differentiated with respect to time, i.e., $dP/dt = 6N(dP/d\theta)$. Thus, using $d\theta = 6Ndt$, we obtain $$\frac{dP/dt}{(dP/dt)r} = \frac{P}{Pr}\ \frac{n}{nr}\ \frac{N}{Nr}$$

thus, the fuel injection Ti is given by $$Ti = Tp \frac{Tr}{T} \frac{(1-\eta e)}{(1-\eta er)} \frac{nr}{n} \frac{Nr}{N}$$

and the fuel injection Tp is given by $$Tp = \frac{dP/dt}{(dP/dt)r} \eta\, cr\, Go$$

requiring only addition of a correction N/Nr for rotation which may be included in f4={(dP/dθ)/(dP/dθ)r, N}.

The operation in FIG. 5 is carried out when the crank interrupt is activated but the operation may be carried out by monitoring the crank angles at all times to thereby detect a predetermined crank angle. Although (dP/dθ)r is directly stored into the memory B after it is detected, the value of (dP/dθ)r before the engine is mounted to the vehicle may be measured as (dP/dθ)ro, and the ratio Kg2 of (dP/dθ)ro to dP/dθ)r may be stored in the memory B, in which case (dP/dθ)/(dP/dθ)r can be obtained by $$\frac{(dP/d\theta)}{(dP/d\theta)r} = \frac{(dP/d\theta)}{(dP/d\theta)ro} Kg2$$

While in the above-described first and second embodiments the fully opened throttle valve was assumed as the reference condition, the embodiments are only exemplary and for example, the idle condition of the engine may be assumed as the reference condition. Also, the cylinder pressure sensor 13 may be of a semiconductor type.

Figure 6A:
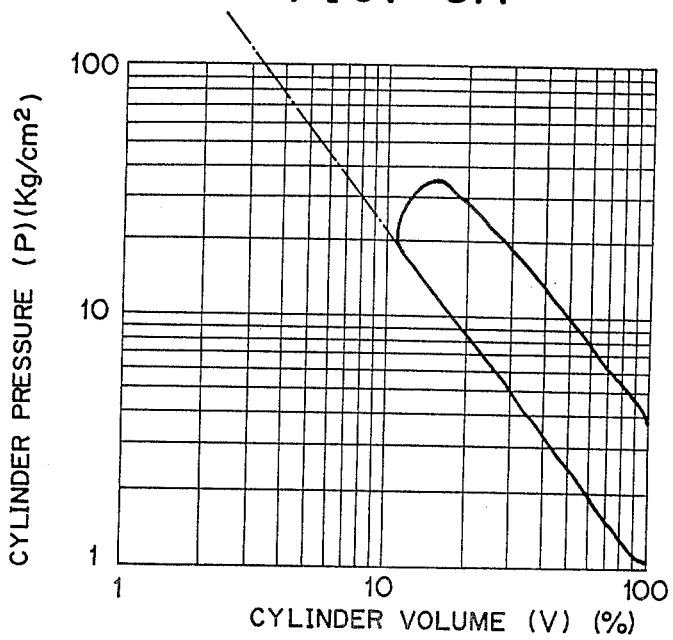
FIGS. 6A–6B are graphs showing the relation between the pressure in the cylinder and the volume of the cylinder in logP–logV scale.
Figure 6B:
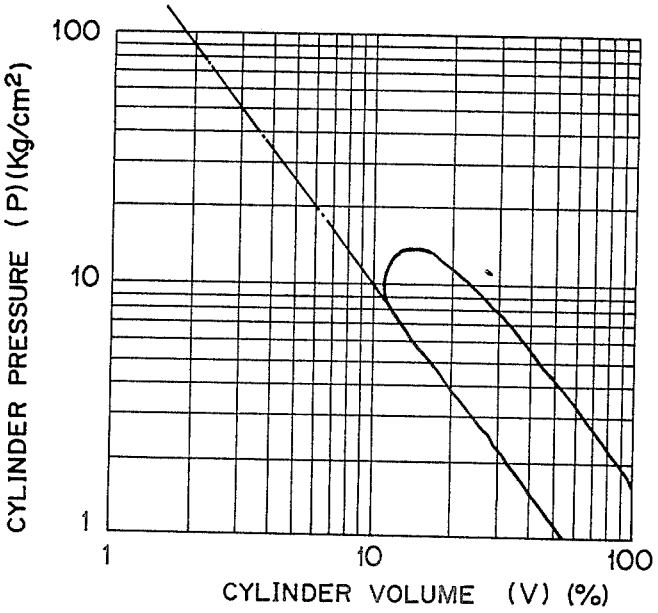
Figure 7:
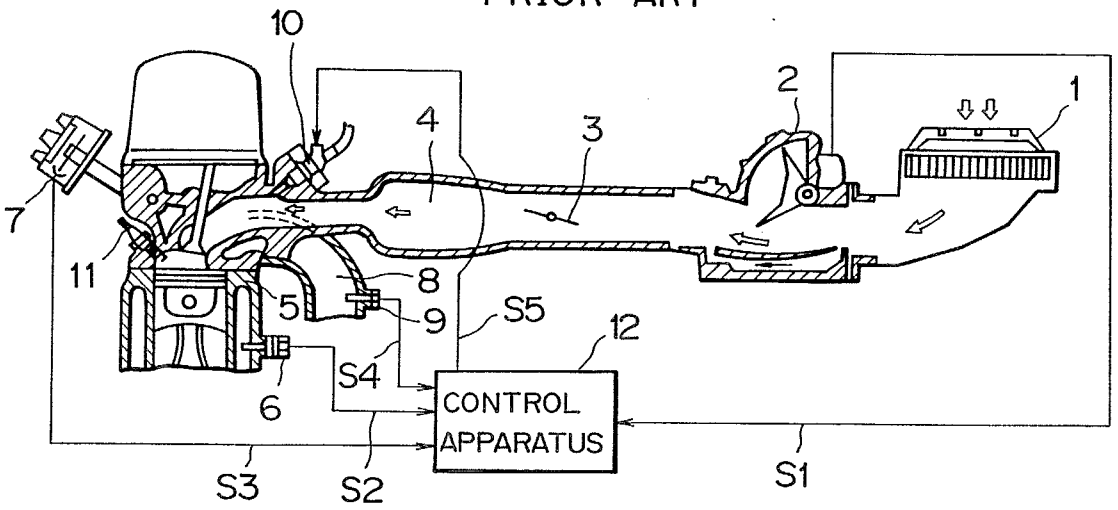
FIG. 7 PRIOR ART
FIG. 7 shows a prior art fuel control apparatus.
Figure 9:
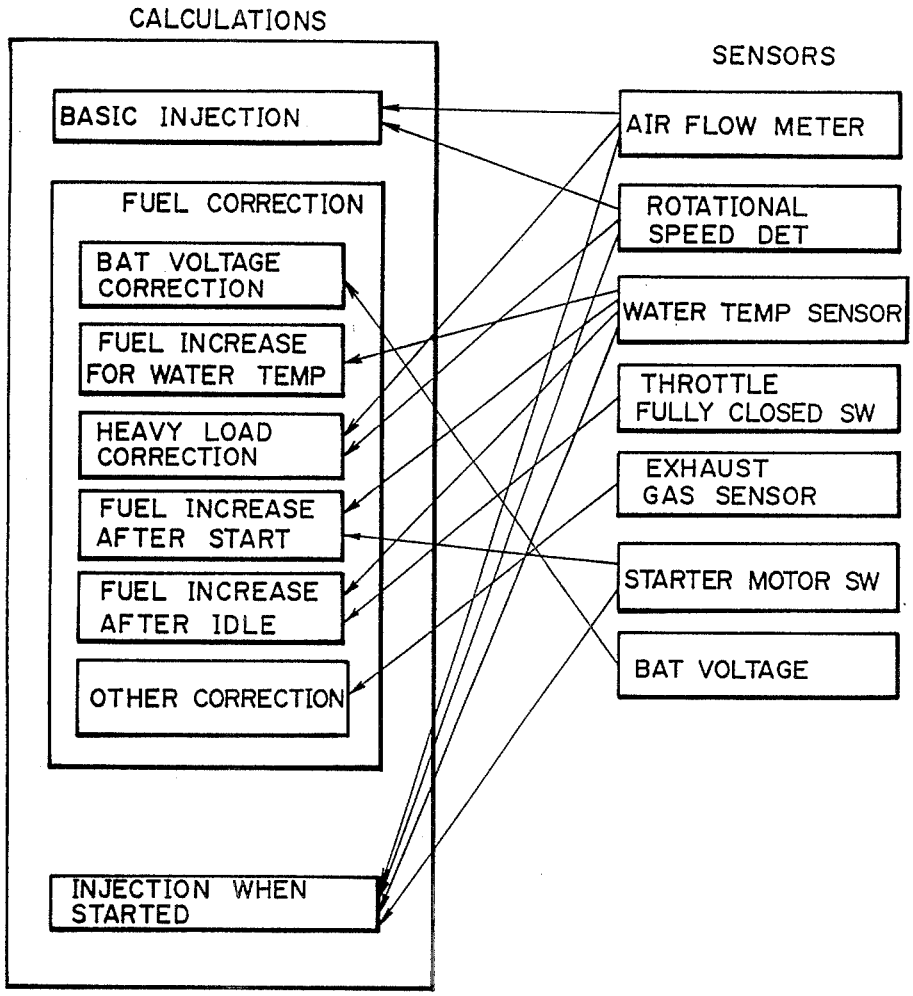
FIG. 9 illustrates the relation between various sensors and the respective corrections calculated on the basis of the outputs of the sensors.
Figure 10:
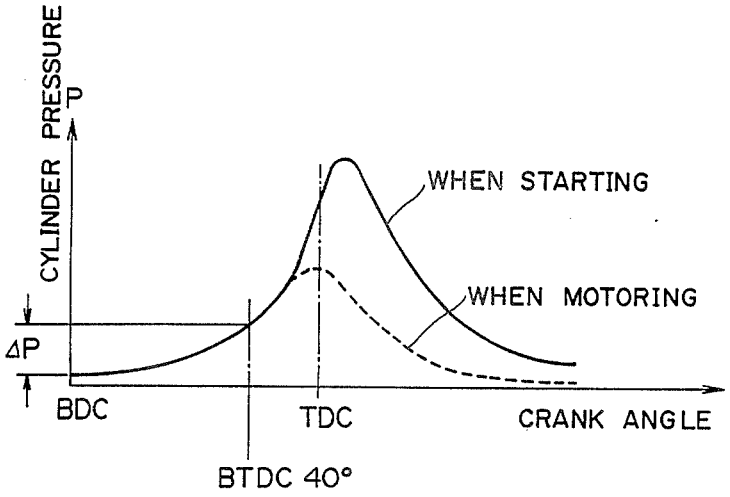
FIG. 10 is a graph showing the relation between the pressure in the cylinder and the crank angle.
Figure 11:
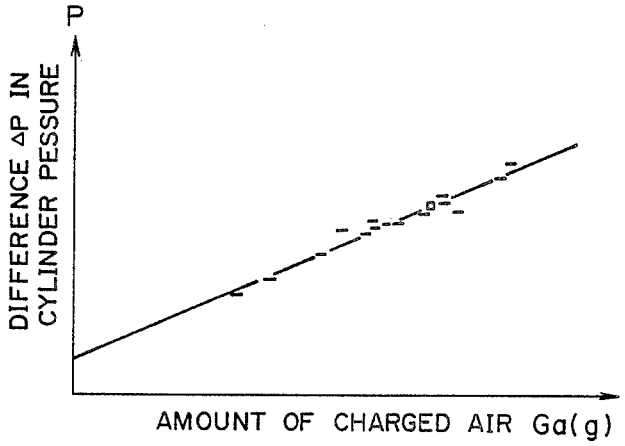
FIG. 11 is a graph showing the relation between the pressure in the cylinder and the air charge amount.

The crank angle θ1 and θ2 should be in a range in which the logP–logV graph of FIGS. 6A–6B are linear so that polytropic change is valid. FIG. 6A shows the logP –logV graph when the throttle is fully opened and FIG. 6B when the engine is partially loaded. In general, the range in which the logP–logV graph has a constant slope, considerably varies from engine to engine since the heat loss from the operating gas in the cylinder must depend only on the temperature of the operating gas. In other words, the polytropic change is valid only when the following relation is satisfied.

$$dq = KdT$$

where dq is a heat loss, T is a gas temperature, and dT is a change in gas temperature T.

The heat loss is dependent on the heat transfer rate in the cylinder and the surface area through which heat is transferred, which varies from engine to engine, and thus the range of crank angles depends on engines. As a rule of thumb, the crank angles θ1 and θ2 can be set somewhere between compression dead center 90 deg. and an angle just before an increase in pressure due to combustion appears.

What is claimed is:

1. A fuel control apparatus for an internal combustion engine comprising:

a pressure sensor for detecting a pressure in a combustion chamber to output a first signal indicative of the pressure in the combustion chamber;

a crank angle sensor for detecting a crank angle to output a second signal indicative of the crank angle during compression stroke of the engine;

calculating means for producing on the basis of said first and second signals a third signal indicative of a change in pressure in the combustion engine for a change in crank angle;

normalization means for normalizing said third signal by a first predetermined reference value to output a fourth signal;

basic-fuel-injection determining means for determining a basic fuel injection of the engine by taking a product of said fourth signal and a second predetermined reference value indicative of an amount of air charged into the combustion chamber.

2. A fuel control apparatus for an internal combustion engine according to claim 1, wherein said third signal indicates a difference in pressure in the combustion chamber between a first crank angle and a second crank angle, and said first predetermined reference value is the difference in pressure in the combustion chamber between said first crank angle and said second crank angle during compression stroke when the engine is in start condition thereof.

3. A fuel control apparatus for an internal combustion engine according to claim 1, wherein said third signal indicates the pressure in the combustion chamber differentiated with respect to crank angle at an arbitrary crank angle during compression stroke, and said first predetermined reference value is the pressure in the combustion chamber differentiated with respect to crank angle at said arbitrary crank angle when the engine is in start condition thereof.

4. A fuel control apparatus for an internal combustion engine according to claim 1, wherein said apparatus further includes means for detecting atmospheric pressure to thereby correct said second predetermined reference value with respect to a change in atmospheric pressure.

* * * * *